US007234512B2

(12) United States Patent
Anderson

(10) Patent No.: US 7,234,512 B2
(45) Date of Patent: Jun. 26, 2007

(54) HEAT EXCHANGER WITH INTERNAL BAFFLE AND AN EXTERNAL BYPASS FOR THE BAFFLE

(75) Inventor: George E. Anderson, Champlin, MN (US)

(73) Assignee: Crown Iron Works Company, Minneapolis, MN (US)

( * ) Notice: Subject to any disclaimer, the term of this patent is extended or adjusted under 35 U.S.C. 154(b) by 101 days.

(21) Appl. No.: 11/178,619

(22) Filed: Jul. 11, 2005

(65) Prior Publication Data

US 2007/0006991 A1 Jan. 11, 2007

(51) Int. Cl.
*F28F 27/02* (2006.01)

(52) U.S. Cl. ..... 165/103; 165/159

(58) Field of Classification Search ..... 165/103, 165/158, 159

See application file for complete search history.

(56) References Cited

U.S. PATENT DOCUMENTS 1,895,876 A * 1/1933 Bennett et al. ..... 165/103
1,989,340 A * 1/1935 Shepherd ..... 165/103
3,920,067 A * 11/1975 Schindler et al. ..... 165/283
5,178,102 A 1/1993 Kehrer et al. ..... 122/367.1
5,575,329 A 11/1996 So et al. ..... 165/167
5,643,544 A 7/1997 Henkelmann ..... 423/245.3
6,003,594 A 12/1999 Cameron et al. ..... 165/297
2003/0034152 A1* 2/2003 Lomax et al. ..... 165/135

* cited by examiner

*Primary Examiner*—Teresa J. Walberg
(74) *Attorney, Agent, or Firm*—Nawrocki, Rooney & Sivertson, P.A.

(57) ABSTRACT

A shell and tube heat exchanger has at least one baffle to support the tubes within the casing of the heat exchanger, wherein the baffle intersects the inner casing wall along a substantial portion of the arc. The baffle has a bypass through which flows at least a portion of the fluid flowing into the casing and around the baffle. At least a portion of the bypass is outside of the casing. This flow of fluid through the bypass reduces pressure drop through the heat exchanger and also reduces to some extent, points adjacent to the baffles where fluid flow may stagnate.

15 Claims, 1 Drawing Sheet

HEAT EXCHANGER WITH INTERNAL BAFFLE AND AN EXTERNAL BYPASS FOR THE BAFFLE

BACKGROUND OF THE INVENTION

In certain manufacturing processes, a heat exchanger is used to transfer heat between a first fluid stream used in the process and a second fluid stream. One common type of such a heat exchanger is called a "shell and tube" heat exchanger. A shell and tube heat exchanger (STHE) has a cylindrical casing having first and second ends. An axis extends between the first and second ends of the casing. A plurality of tubes within the casing extends nearly the entire length thereof. A large industrial STHE may have literally thousands of tubes each displaced radially within the casing from those adjacent to allow fluid to flow radially between individual tubes as well as axially along the axis of the casing.

One type of STHE includes a first end plate having a first inlet port therein. The first end plate is sealed to the first end of the casing, say by a continuous weld between the edge of the end plate and the edge of the casing's first end. A second end plate having a first outlet port seals the second end of the casing in a similar way.

A first tubesheet spaced from the first end plate forms with the first end plate and the adjacent casing wall, a first plenum space, or more briefly, first plenum. The adjacent ends of the tubes all penetrate the tubesheet and open into the first plenum. The exterior walls of the tubes are sealed to the first tubesheet to isolate the first plenum from the remaining space within the casing. The first plenum receives the first fluid stream at the first inlet port and distributes the first fluid stream to the open ends of the individual tubes within the first plenum. The first inlet port can also be placed in the casing between the first end plate and the first tubesheet.

A second tubesheet spaced from the second end plate forms with the second end plate and the adjacent casing wall, a second plenum space (second plenum). The adjacent ends of the tubes all penetrate the second tubesheet. The exterior walls of the tubes are sealed to the second tubesheet to isolate the second plenum from the space between the tubesheets. The second plenum directs the first fluid stream flowing from the individual tubes to the first outlet port. The first outlet port can also be placed in the casing between the second end plate and the second tubesheet.

A second inlet port is mounted in the casing between the tubesheets near either the first or second tubesheet. A second outlet port is mounted in the casing between the tubesheets near the other of the tubesheets. The second inlet port receives the second fluid stream which flows across the tubes to the second outlet port.

Since the tubes are often long with relatively thin walls, lateral support is often necessary to prevent them from bending or vibrating during operation of the STHE. This problem is often addressed by a plurality of baffles formed from a metal sheet and located between the tubesheets. Each baffle extends substantially perpendicular to the axis. Each baffle has preformed holes through which the tubes pass to provide this lateral support for the tubes. The baffles are held in axial position by welding to support rods axially extending through the casing, or even to the casing itself. A typical STHE may have anywhere from one to a dozen or more baffles depending on the length of the STHE. If the STHE is relatively short, no baffles may be necessary. In a long STHE with thin-walled tubes, baffles may be placed as close to each other as six inches.

A portion of a baffle's periphery is often in close proximity to the inside of the casing. In other cases, the baffles may be centrally located with arms or spokes extending radially to the casing, or may be held in place with support rods.

Each baffle is usually pierced by at least half of the tubes, but substantially less than all of them. Adjacent baffles are often arranged to project from opposite sides of the casing, so that fluids passing from the second inlet port to the second outlet port have a somewhat serpentine path through the interior of the casing. The baffles also assure that flow of the second fluid stream is directed toward at least part of the length of most of the tubes.

Some STHEs may have series-connected tubes so that flow entering a particular tube traverses the length of the casing two, three, or more times. Where the flow traverses the casing an even number of times, both plenums will typically be on the same end of the casing. All of these variations are well known to those familiar with the technology. The invention to be described can be easily adapted for any of the designs.

This conventional design of a STHE has some flaws. A large pressure drop in the second fluid stream is sometimes present between the second inlet port and the second outlet port. A substantial portion of this pressure drop results from the serpentine path the fluid must take around the baffles. This large pressure drop requires a larger capacity pump or blower. It would be desirable in some circumstances to reduce the pressure drop through a STHE.

Secondly, the baffles cause points of stagnation where the baffles intersect the inner surface of the casing. This causes inefficient heat transfer between the first and second fluid streams.

BRIEF DESCRIPTION OF THE INVENTION

The invention is an improvement for a heat exchanger of the type having a cylindrical casing with an axis; a plurality of tubes within the casing and extending substantially the length thereof; and at least one sheet-type baffle intersecting the casing inner wall along a preselected arc and extending substantially transversely to the casing axis. The tubes pass through the baffle, which supports the tubes. The baffle occludes a portion only of the casing cross section.

The improvement comprises at least one fluid bypass at least partly external to the casing and in fluid communication with the interior of the casing on both sides of the baffle, and allowing fluid flow across the baffle.

DESCRIPTION OF THE PREFFERED EMBODIMENTS

Figure 1:
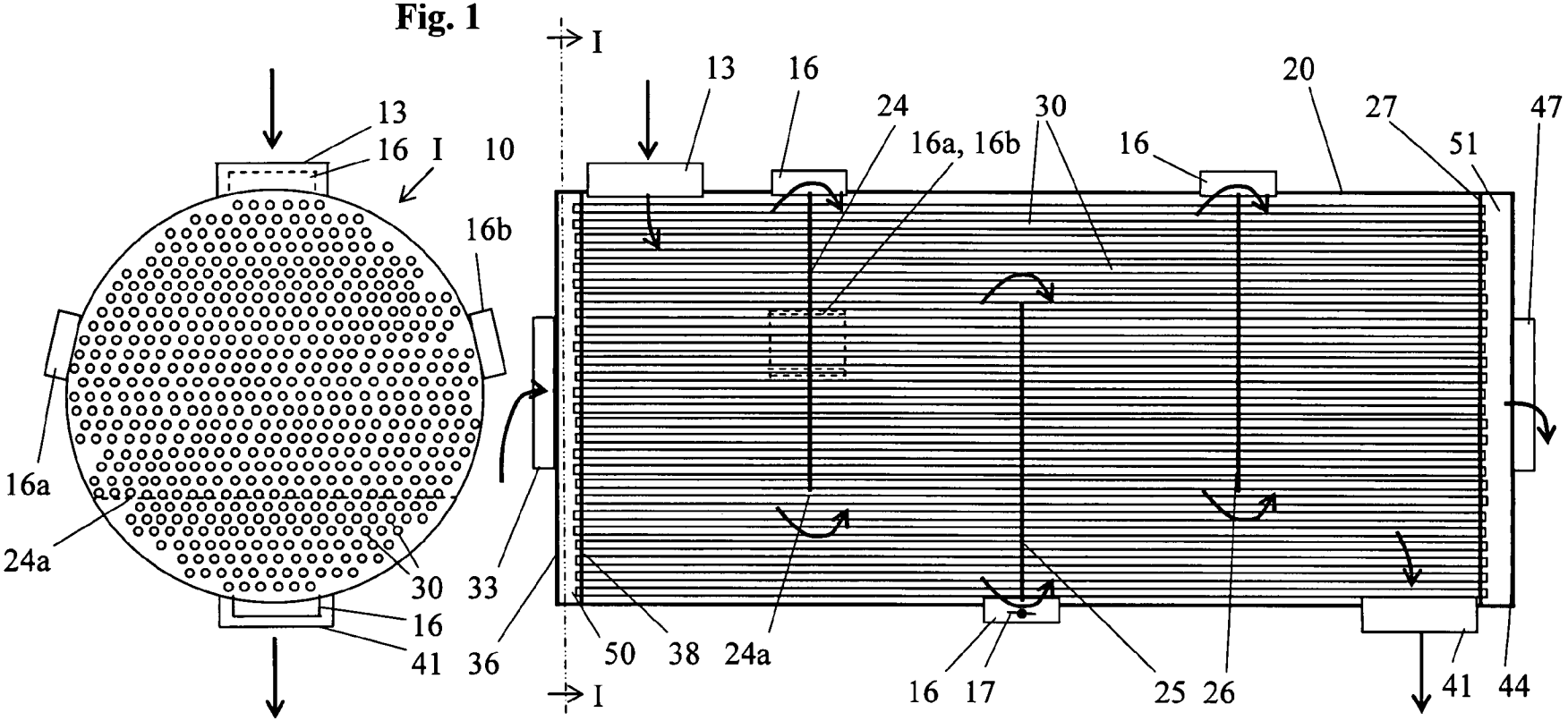
FIG. 1 shows specialized front and side projection views of the heat exchanger.

The right side of FIG. 1 shows a side view of a shell and tube heat exchanger (STHE) 10. The side view in FIG. 1 shows a casing 20 of the heat exchanger 10 as though the side of casing 20 facing the viewer is transparent.

FIG. 1 shows on the left side thereof an end view projection of the heat exchanger 10. The end view is the section I of heat exchanger 10 as indicated in the side view, thereby allowing the viewer to see the internal structure of heat exchanger 10.

The STHE 10 in FIG. 1 has a fairly simple configuration. The invention is useful in any STHE having a radially extending baffle that intersects the interior wall of casing 20 along more than a small included angle. By "intersects" here is meant that at most, only an insignificant amount of fluid can flow between the baffle and the casing 20 within the included angle.

The two views shown in FIG. 1 should be considered together in understanding the invention. The end view shows a large number of tubes 30 through which pass a first of two fluid streams. The side view shows a first end plate 36 connected around its periphery to form a fluid-tight seal with the end of casing 20. In typical heat exchanger designs, tubes 30 may occupy 10-20% of the casing 20 cross section area.

Tubes 30 may project a small distance through a first tubesheet 38 spaced from first end plate 36, or may be substantially flush with first tubesheet 38. Tubesheet 38 forms a seal with the outer wall of each of the tubes 30, by rolling for example. The periphery of plate 38 forms a fluid-tight seal with the interior surface of casing 20 by welding for example.

The first fluid stream flows through a first inlet port 33 in first end plate 36 into an inlet plenum 50 formed collectively by first end plate 36, first tubesheet 38, and the portion of casing 20 between plates 36 and 38. (Plenum 50 is shown smaller than preferred in order to fit FIG. 1 on a single page.) The first fluid stream then flows from plenum 50 into tubes 30.

The first fluid stream flows through tubes 30 to an outlet plenum 51 formed collectively by a second end plate 44, a second tubesheet 27, and the portion of casing 20 between plates 27 and 44. Second tubesheet 44 forms a seal with the outer wall of each of the tubes 30. The periphery of plate 44 forms a fluid-tight seal with the interior surface of casing 20.

The first fluid stream then exits through a first outlet port 47 in second end plate 44. Depending on the particular requirements of the application, the flow direction may be opposite that described, and instead from outlet port 47 to inlet port 33.

A second fluid stream enters a second inlet port 13 to casing 20 and flows through casing 20 to a second outlet port 41. The heavy arrows within casing 20 generally indicate the second fluid stream's path. In the course of the second fluid stream flowing from port 13 to port 41, the first and second fluid streams exchange heat.

Because tubes 30 are very long compared to their diameter, baffles 24-26 for lateral support of tubes 30 are considered necessary in many designs. Baffles 24-26 intersect (see definition above) the interior wall of casing 20 and are firmly attached, perhaps by welding, to the interior wall of casing 20. Tubes 30 fit through aligned holes drilled or punched in individual baffles 24-26. In general, a fluid-tight seal between baffles 24-26 and tubes 30 is unnecessary. Nor is a fluid-tight seal between a baffle 24-26 and the inner wall of casing 20 necessary.

Obviously, if a baffle 24-26 should occlude the entire cross section of casing 20, little or no fluid can flow from second inlet port 13 to second outlet port 41. For this reason, each baffle 24-26 may occlude anywhere between less than 50%-75% of the casing 20 cross section. Baffle 24 is shown as having an edge 24*a* forming a chord of the circle of the casing 20 cross section. The choice for the shape of the unsupported edge is somewhat arbitrary, but a straight line edge 24*a* is simple to form.

Figure 2:
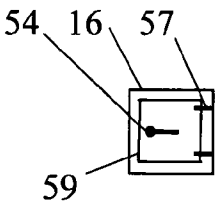
FIG. 2 shows a preferred embodiment for a bypass.

To provide support for all of the tubes 30 and at the same time allow flow of the second fluid stream from second inlet port 13 to second outlet port 41, the baffles 24-26 alternately extend in opposite directions as shown in the side view of FIG. 2. In the example shown in FIG. 1, a portion of the tubes 30 are supported only once, at their midpoint, by baffle 25. A centrally located portion of tubes 30 are supported by all three baffles 24-26. A further portion of tubes 30 are supported by two baffles 24 and 26.

Depending on the length of the heat exchanger 10 involved, more than three baffles 24-26 may be required. However, it is generally best to have the fewest required to adequately support tubes 30. This is because of the generally serpentine path for flow of the second fluid stream the baffles 24-26 create. As previously mentioned, this serpentine path through the maze of tubes 30 causes substantial pressure drop between second inlet port 13 and second outlet port 41.

The fewest number of baffles 24-26 required is also preferred because the areas adjacent to the line of intersection for each of the baffles 24-26 with the inner wall of casing 20 are occupied by stagnant fluid. These areas are stagnant because there is little pressure drop across them to flush out the fluid in those areas.

Both the pressure drop problem and the stagnant fluid problem can be alleviated to some extent by adding bypasses 16 around the peripheries of baffles 24-26 where attached to the inside wall of casing 20. The bypasses 16 preferably occupy space outside of casing 20 so as to allow lateral support of each of the tubes 30 adjacent to the particular bypass 16. Heavy arrows within each bypass 16 and around the individual baffle edges 24*a*, etc. show the flow path for the second fluid stream.

Preferably, the bypasses 16 are external to casing 20 so that the entire flow path through a bypass 16 is external to the casing 20. This feature allows the entire casing 20 to be filled with tubes 30 where each tube 30 is supported by as many of the baffles 24-26 as possible. It is of course possible to provide internal or partially internal bypasses for the baffles 24-26, but this results in a less efficient use of internal casing 20 space and is presently not considered to be preferred. At least a portion of a bypass 16 should be external to casing 20.

In one version, a bypass 16 comprises a box projecting outwardly from the casing 20 and forming a seal therewith. The seal between bypass 16 and casing 20 may comprise a welded seam or bolts than press a flange with a gasket against the exterior surface of casing 20.

If a baffle 24-26 has a single bypass 16, the most desirable location for such a bypass is substantially diametrically located with respect to the baffle edge 24*a*. Thus, the bypass 16 for baffle 24 is diametrically opposed to edge 24*a*, as shown in the two views of FIG. 1.

A typical bypass 16 may often need only 3% of the cross section area of casing 20 to improve performance of an STHE 10. Such a bypass 16 may pass 10% of the total flow of the second fluid stream. This estimate is reasonable because the flow area between adjacent bypasses 16 and between the tubes 30 extending between the adjacent bypasses is usually substantially less than the cross section area of casing 20. Because the flow through a bypass 16 is essentially unobstructed, a single bypass 16 can accommodate a much larger flow than can an area of similar size within casing 20.

In one particular commercial STHE 10 having a casing 20 diameter of 8 feet, a bypass 16 whose footprint on casing 20 is 1 ft.×2 ft. and which projects 1 ft. from casing 20 is adequate for typical flow rates of a second fluid stream.

A preferred embodiment may have more than one bypass per baffle 24. FIG. 1 shows in the end view additional bypasses 16*a* and 16*b* around the periphery of bypass 24.

Additional bypasses 16*a* and 16*b* reduce the stagnation areas at the periphery of baffle 24. Of course, each of the baffles 25 and 26 may also have more than one bypass 16.

A baffle 16 may have a damper 17 by which an operator can control the amount of flow through a particular baffle 16. In some circumstances, heat transfer may be maximized by controlling the amount of fluid flow through a particular baffle 16 relative to other baffles 16. In other circumstances, the most efficient operation of STHE 10 occurs with a selected flow rate for the fluid forming the second fluid stream. The flow rate for the second fluid stream may also influence the flow rate through individual baffles 16.

FIG. 2 shows a further feature for a baffle 16. Once a STHE 10 is provided with bypasses 16, it is quite simple to add an access door 59 to a baffle 16. A door 59 may have hinges 57 and a latch or lock 54. Such a door 59 allows access to the adjacent baffle 24-26 for cleaning and other types of service. Conveniently, each of the baffles 16 in the STHE 10 of FIG. 1 may have such an access door 59.

The invention claimed is:

1. In an improved heat exchanger of the type having a cylindrical casing with an axis; a plurality of tubes within the casing and extending substantially the length thereof; and at least one sheet-type baffle intersecting the casing inner wall along a preselected arc and extending substantially transversely to the casing axis, through which baffle the tubes pass and which supports the tubes, the baffle occluding a portion only of the casing cross section, wherein the improvement comprises at least one fluid bypass at least partly external to the casing and in fluid communication with the interior of the casing on both sides of the baffle, and allowing fluid flow across the baffle.

2. The improved heat exchanger of claim 1, including a plurality of baffles intersecting the casing inner wall wherein each baffle has at least one bypass.

3. The improved heat exchanger of claim 2, wherein at least one baffle has a plurality of bypasses.

4. The improved heat exchanger of claim 3, wherein at least one baffle bypass has an access door allowing access to the interior of the casing.

5. The improved heat exchanger of claim 4, wherein each baffle has at least one bypass with an access door.

6. The improved heat exchanger of claim 1, wherein the bypass comprises a box projecting outwardly from the casing and sealed thereto.

7. The improved heat exchanger of claim 6, wherein the box has an external surface with an access door.

8. The improved heat exchanger of claim 6, wherein the box includes an internal damper for regulating fluid flow through the box.

9. The improved heat exchanger of claim 1, wherein the heat exchanger further includes a first inlet port communicating with the casing adjacent to a first end of a first tube and a first outlet port adjacent to a second end of the first tube, and wherein the heat exchanger further includes a first baffle between the first inlet port and the first outlet port, and wherein the heat exchanger includes a plurality of bypasses around the first baffle.

10. The improved heat exchanger of claim 9, wherein the first baffle has an edge unsupported by and spaced from the casing, wherein at least one bypass is substantially diametrically located on the casing with respect to the first baffle edge.

11. The improved heat exchanger of claim 10, including at least three bypasses for the first baffle.

12. The improved heat exchanger of claim 1, wherein the baffle has an edge unsupported by and spaced from the casing, wherein one bypass is substantially diametrically located on the casing with respect to the baffle edge.

13. The improved heat exchanger of claim 10, including at least three bypasses for the baffle.

14. The improved heat exchanger of claim 13, wherein at least one of the bypasses is completely external to the casing.

15. The improved heat exchanger of claim 1, wherein the bypass is completely external to the casing.

* * * * *